US010378294B2

(12) United States Patent
Mineo et al.

(10) Patent No.: US 10,378,294 B2
(45) Date of Patent: Aug. 13, 2019

(54) STORAGE AND DEPLOYMENT SYSTEM FOR A COMPOSITE SLICKLINE

(71) Applicant: Halliburton Energy Services, Inc., Houston, TX (US)

(72) Inventors: Richard Mineo, Richardson, TX (US); Dominick Joseph Bellotte, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 135 days.

(21) Appl. No.: 15/322,243

(22) PCT Filed: Jul. 31, 2014

(86) PCT No.: PCT/US2014/049125

§ 371 (c)(1),
(2) Date: Dec. 27, 2016

(87) PCT Pub. No.: WO2016/018362

PCT Pub. Date: Feb. 4, 2016

(65) Prior Publication Data

US 2017/0152715 A1 Jun. 1, 2017

(51) Int. Cl.

| | |
|---|---|
| ***E21B 19/00*** | (2006.01) |
| ***E21B 19/22*** | (2006.01) |
| ***E21B 17/20*** | (2006.01) |

(52) U.S. Cl.

CPC ..... *E21B 19/008* (2013.01); *E21B 17/20* (2013.01); *E21B 19/22* (2013.01)

(58) Field of Classification Search

CPC ..... E21B 19/008; E21B 17/20; E21B 19/22; B65H 49/02

(Continued)

(56) References Cited

U.S. PATENT DOCUMENTS 3,272,455 A * 9/1966 Sternberg ..... B21C 47/20 242/171
3,399,415 A * 9/1968 Hammond ..... B08B 9/045 15/104.33

(Continued)

FOREIGN PATENT DOCUMENTS

KR 20-0431094 Y1 11/2006

OTHER PUBLICATIONS

International Search Report and Written Opinion dated Apr. 28, 2015; International PCT Application No. PCT/US2014/049125.

*Primary Examiner* — Michael R Wills, III
(74) *Attorney, Agent, or Firm* — McGuireWoods LLP

(57) ABSTRACT

A slickline for use in a wellbore comprising: the slickline, wherein the slickline: comprises a composite material comprising a plurality of carbon fiber strands, and is housed on the inside of a receptacle, wherein the receptacle is hollow and cone-shaped. The slickline can also be made from an anisotropic material; and wherein a first test section of the slickline has a stiffness greater than a second test section having the same dimensions as the first test section but made of steel. A method of deploying the slickline into a wellbore comprising: positioning a portion of the slickline into a controlled deployment device, wherein the controlled deployment device comprises a housing; and causing at least a portion of the slickline to enter the wellbore, wherein the slickline moves from the receptacle through the housing and into the wellbore during the step of causing.

23 Claims, 5 Drawing Sheets

(58) Field of Classification Search
USPC ..... 242/170, 171, 175, 328, 261.2, 387, 242/574.3
See application file for complete search history.

(56) References Cited

U.S. PATENT DOCUMENTS 3,928,885 A * 12/1975 Peterson ..... B08B 9/045 15/104.33
4,015,795 A 4/1977 Chong
4,258,834 A * 3/1981 Hawley ..... B65H 51/06 191/12.2 R
5,374,005 A * 12/1994 Jenkins ..... G01L 5/047 73/152.59
6,516,892 B2 * 2/2003 Reilly ..... E21B 19/22 166/384
7,100,863 B2 * 9/2006 Hsu ..... B21C 47/20 206/408
7,347,257 B2 * 3/2008 Van Way ..... E21B 19/22 166/77.2
7,444,861 B2 * 11/2008 De Jesus ..... E21B 19/22 73/152.59
7,769,260 B2 8/2010 Hansen et al.
7,909,106 B2 * 3/2011 Van Way ..... E21B 19/10 166/380
8,613,310 B2 * 12/2013 Denoix ..... E21B 33/072 166/77.2
2008/0118209 A1 * 5/2008 Varkey ..... G02B 6/4486 385/101
2011/0154908 A1 * 6/2011 Mckee ..... E21B 19/22 73/829
2011/0168401 A1 7/2011 Herbert
2011/0234421 A1 9/2011 Smith
2014/0183428 A1 7/2014 Wright et al.
2016/0362275 A1 * 12/2016 Rock ..... B60P 3/035

* cited by examiner

STORAGE AND DEPLOYMENT SYSTEM FOR A COMPOSITE SLICKLINE

TECHNICAL FIELD

Slicklines are used in a variety of oil and gas wellbore operations. A slickline can be housed on a drum or in a receptacle until used in the operations. The slickline can be deployed into a wellbore from the receptacle.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
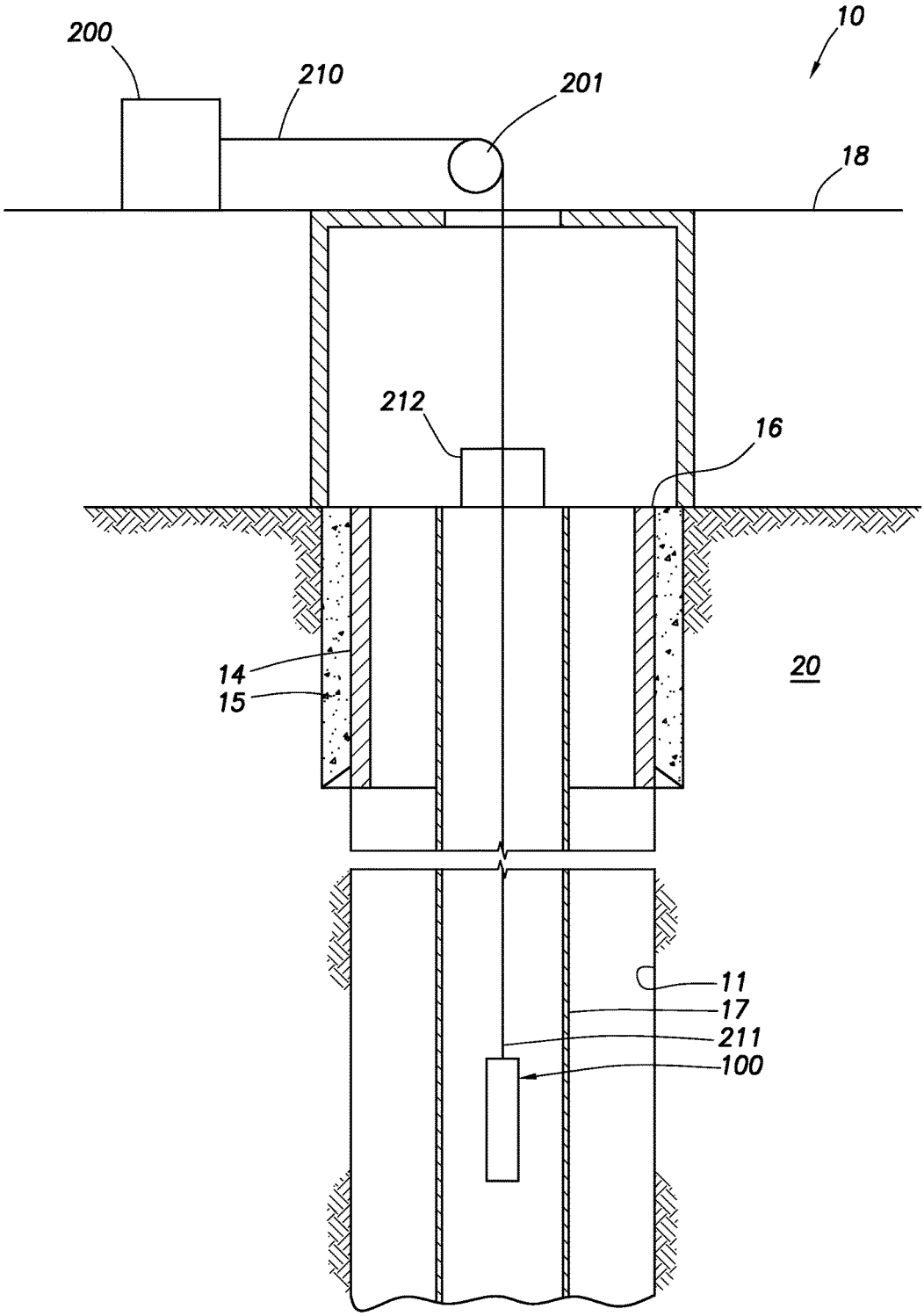
FIG. 1 is a cross-sectional view of a well system including a storage and deployment system for a slickline according to certain embodiments.

As used herein, the words "comprise," "have," "include," and all grammatical variations thereof, are each intended to have an open, non-limiting meaning that does not exclude additional elements or steps.

Oil and gas hydrocarbons are naturally occurring in some subterranean formations. In the oil and gas industry, a subterranean formation containing oil or gas is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from the wellbore is called a reservoir fluid.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered the region within approximately 100 feet radially of the wellbore. A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

There are a variety of oil and gas operations that utilize a slickline. Generally, a slickline is a thin, non-electric cable or a single-strand wireline having a slick outside. Slicklines can be used, for example, to selectively place and retrieve wellbore tools, such as plugs, gauges, and valves and to adjust downhole valves and sleeves. Slicklines can be used during well completion, workover, and intervention operations.

Slicklines are commonly wrapped around the outside of a cylindrical-shaped drum. The slickline is wound around the outside of the drum much like thread is wound around the outside of a spool. The slickline is placed onto the drum via circular rotation about a longitudinal axis of the drum. Likewise, the slickline is unwound from the drum and placed into the wellbore by reversing the direction of the circular rotation (i.e., clockwise or counter clockwise from a fixed end of the longitudinal axis).

Certain types of slicklines are capable of being stored and deployed into a wellbore from a drum. For example, a common material that slicklines are made from is steel. Steel is an isotropic material, meaning that it has the same physical and mechanical properties in all directions. By contrast, an anisotropic material has properties that are dependent on direction. An example of an anisotropic material is wood, which is easier to split along its grain than against it. Steel slicklines can also have less stiffness compared to other types of slicklines. Stiffness defines the rigidity of an object (i.e., the amount of resistance to deformation or bending in response to an applied force). Stiffness has no meaning unless the material(s) making up the object and the length and thickness (i.e., the dimensions) of the object are specified. When comparing the stiffness of two different sections of a slickline for example, only one parameter should be different (e.g., the dimensions should be the same but the material(s) making up the sections could be different). The isotropic nature and decreased amount of stiffness enables most steel slicklines to be successfully wound around the outside of the drum for storage or deployment.

However, there are certain types of slicklines that are incapable of being successfully wound around a drum, for example, slicklines that are anisotropic and/or have a higher amount of stiffness. These types of lines are generally straight and tend to resist bending, for example around the outside of the drum. The amount of force required to bend the line around the outside of a drum can create a high amount of tension on the line. The line, being forced counter to its naturally straight orientation, will want to straighten out. Trying to force these types of lines into this unnatural orientation can lead to safety issues if the line is accidentally released during winding as the line can snap back and quickly, and often times violently, uncoil from the drum. Furthermore, the tension created can cause damage to these lines; and when optical or acoustic cables are part of the slickline, then damage can occur to these cables or the life of the cables can be shortened.

Thus, there is a need for improved storage and deployment reels that can be used with stiffer slicklines or slicklines that resist being wound around a drum. It has been discovered that a receptacle and deployment device can be used to house and deploy these types of slicklines. The slickline can be threaded into the inside of a receptacle safely and efficiently.

According to an embodiment, a slickline system for use in a wellbore comprises: (A) a receptacle, wherein a slickline is housed on the inside of the receptacle, and wherein the receptacle is hollow and cone-shaped, wherein the slickline comprises a composite material comprising a plurality of carbon fiber strands; and (B) a controlled deployment device, wherein the controlled deployment device comprises a housing, and wherein the controlled deployment device deploys at least a portion of the slickline into or from the receptacle. The slickline can also be made from an anisotropic material; and wherein a first test section of the slickline has a stiffness greater than a second test section having the same dimensions as the first test section but made of steel.

According to another embodiment, a method of deploying the slickline into a wellbore comprising: positioning a portion of the slickline into a controlled deployment device, wherein the controlled deployment device comprises a housing; and causing at least a portion of the slickline to enter the wellbore, wherein the slickline moves from the receptacle through the housing and into the wellbore during the step of causing.

According to another embodiment, a method of housing a slickline for use in a wellbore comprises: positioning a portion of the slickline into a controlled deployment device, wherein the controlled deployment device comprises a housing; and inserting the slickline into a receptacle using the controlled deployment device, wherein the receptacle is hollow and cone-shaped, and wherein after the step of inserting, the slickline is housed inside of the receptacle.

Any discussion of a particular component of the well system or storage and deployment system (e.g., the slickline) is meant to apply to all of the method embodiments and the system or apparatus embodiments without the need to re-state all of the particulars for each of the embodiments.

Turning to the Figures, FIG. 1 is a diagram of a well system 10. The well system includes a wellbore 11. The wellbore 11 can penetrate a subterranean formation 20 and extend into the ground from a wellhead 16. Portions of the wellbore 11 can include a casing 14. The casing 14 can be cemented in place using a cement 15. At least one tubing string 17 can be placed within the wellbore 11. Tools and/or equipment can be located on a table 18 located above the wellhead 16.

According to certain method embodiments, a slickline 210 is deployed into the wellbore 11. According to certain embodiments, the slickline 210 comprises a composite material. The composite material includes a plurality of carbon fiber strands. The composite material includes at least one other type of substance. For example, the composite material can also include aramid fibers, steel strands, or combinations of fibers bonded together with thermoplastics (i.e., polyether ether ketone "PEEK," poly(p-phenylene sulfide) "PPS," etc.) and/or thermosets (i.e., epoxies), for example. The slickline can also include one or more fiber optic cables for powering downhole tools or equipment 100. The fiber optic cable can also be used for communications or the slickline can also include communication lines for communicating with the downhole tools or equipment 100. The strands can be braided or attached together and can act as a single unit and move and stretch together as a whole. The slickline 210 can also include a slick coating on the outside of the strands.

According to certain embodiments, the slickline 210 is made from an anisotropic material. The anisotropic material can be the composite material. The slickline is preferably not predominately (i.e., greater than about 70%) made from a metal or metal alloy, such as any kind of steel. According to other embodiments, a first test section of the slickline has a stiffness greater than a second test section having the same dimensions as the first test section but made of steel. For example, the first and second test sections can each have an outer diameter of 1 inch and a length of 1 foot, with the only difference being the materials making up the test sections. Unlike a steel slickline, the stiffness of the slickline 210 can make it difficult or impossible for it to be wound around the outside of a drum. Accordingly, the stiffness is greater than that of steel for a section having the same dimensions (i.e., length and diameter or thickness).

Figure 3:
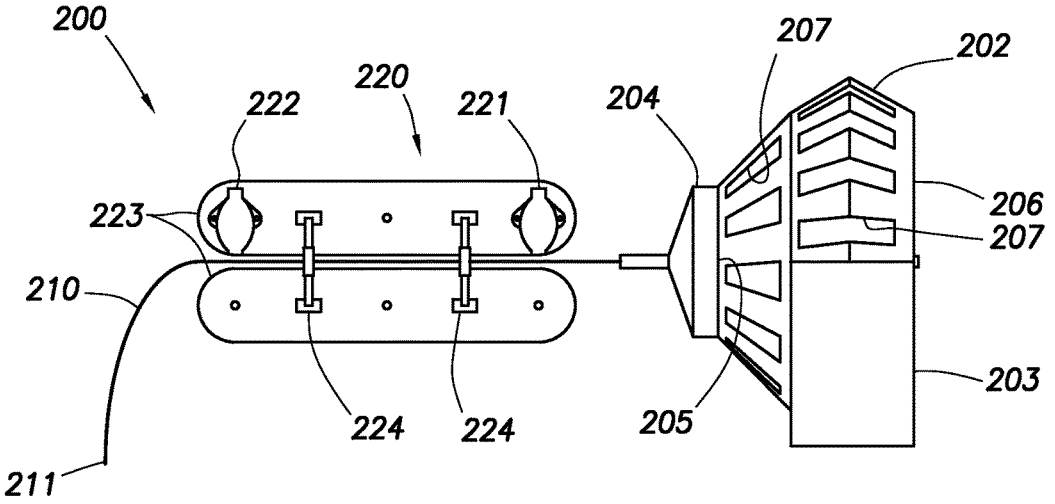
FIG. 3 is a side cross-sectional view of the storage and deployment system including a receptacle and a controlled deployment device.
Figure 4:
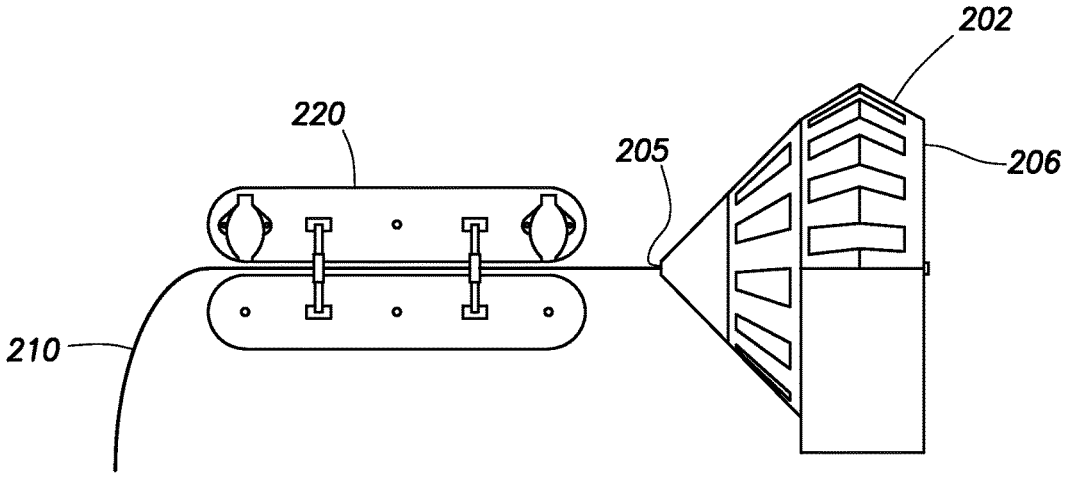
FIG. 4 is a side cross-sectional view of the storage and deployment system showing the controlled deployment device according to other embodiments.

Turning to FIG. 3, an illustrative storage and deployment system 200 is shown. The storage and deployment system 200 includes the slickline 210 and a receptacle 202. The slickline 210 is housed on the inside of a receptacle 202. The receptacle can be made from a variety of materials, including but not limited to, metals, metal alloys, wood, plastics, and composites. The receptacle 202 is hollow. The receptacle 202 can have a wall thickness that is the difference between the outer diameter and inner diameter of the receptacle. The receptacle 202 is cone-shaped. As used herein, an object having a "cone shape" means any object that has tapered sides that taper in from a geometric-shaped base towards an apex. The base 206 of the receptacle 202 can be a variety of geometric shapes, including but not limited to, circular, elliptical, and polygonal (including square, rectangular, pentagonal, hexagonal, etc.). The storage and deployment system 200 can also include a holder 203 for the receptacle. The holder 203 can have a flat base. The receptacle 202 can fit down into the holder 203. This embodiment can be useful when the base 206 is circular or elliptical and the receptacle would tend to roll when positioned on its side. The holder 203 can be used to prevent rolling of the receptacle 202. Of course if the base 206 is polygonal in shape having at least one flat side, then the holder 203 may not be necessary. As can be seen in FIG. 3, the receptacle 202 can be frustum-shaped wherein a plane truncates the apex. As used herein, the term "frustum" means a cone-shaped object wherein the apex of the object is truncated by a truncation plane that is parallel to the base of the object. As can be seen in FIG. 4, the receptacle can have an apex.

The storage and deployment system 200 further includes a controlled deployment device 220. The controlled deployment device 220 includes a housing 223. The housing 223 can include two pieces held together via one or more connectors 224. The housing 223 can include a passageway for the movement or passage of the slickline 210. The passageway can be designed such that a desired amount of latitudinal tension can be placed along the length of the slickline 210 located within the housing 223. For example, the inner diameter of the passageway can be adjusted to control the amount of tension on the slickline in the housing. This tension can help ensure that the slickline 210 is moved through the housing 223. The tension can also help guide the slickline into the wellbore or into the receptacle. Preferably, no longitudinal tension is exerted on the portion of the slickline located within the housing 223.

Figure 2:
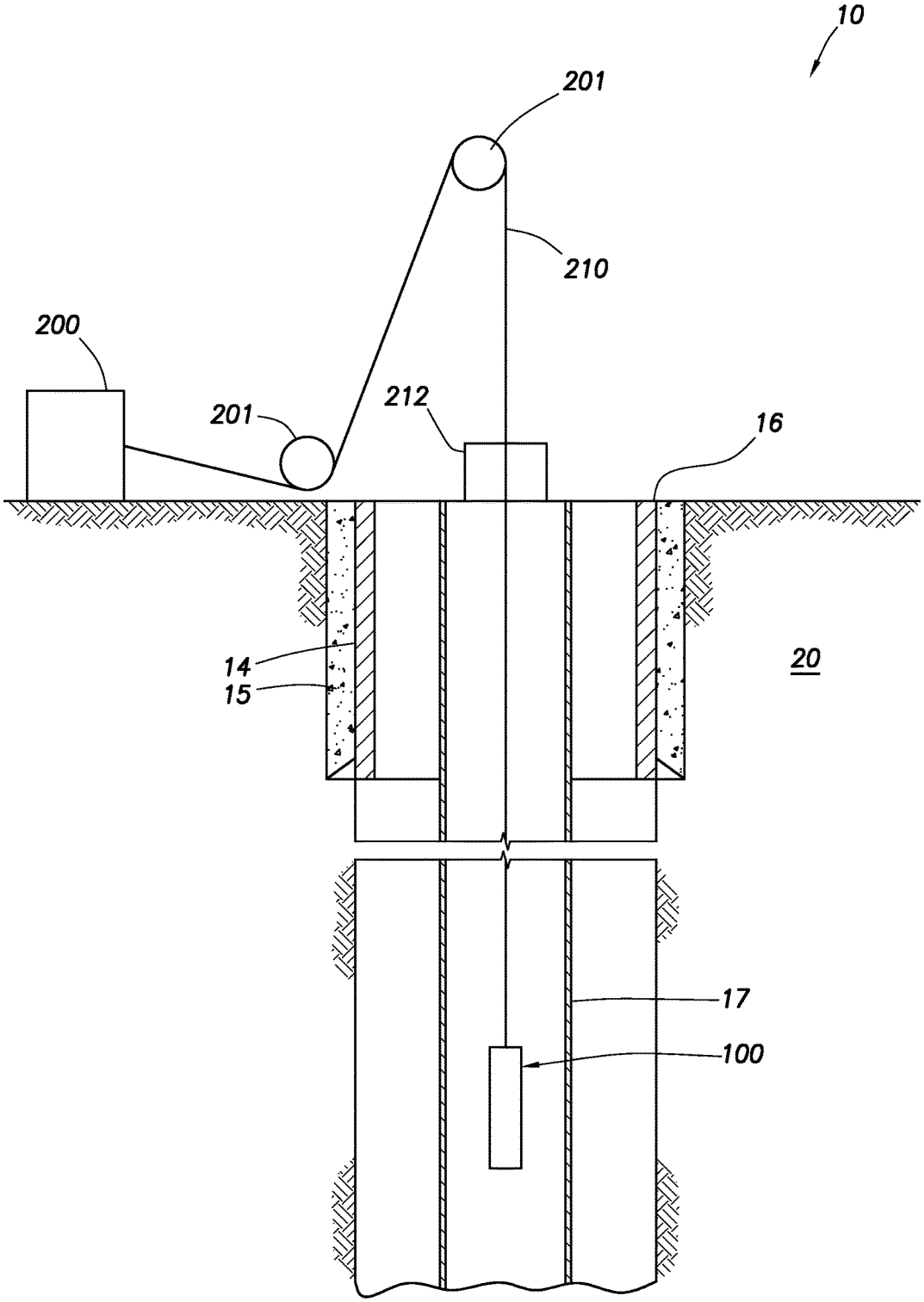
FIG. 2 is a cross-sectional view of a well system including a storage and deployment system for the slickline according to other embodiments.

The controlled deployment device 220 can also include one or more motors. The motors can be used to move or deploy the slickline 210 from the receptacle 202 through the housing 223 and into the wellbore 11. By way of example, the controlled deployment device 220 can include a driving motor 221. The driving motor can be activated, which causes the slickline 210 to move through the housing 223. The direction of the driving motor can be reversed to cause the slickline 210 to move through the housing 223 and into the receptacle 202. According to certain embodiments, there is a longitudinal tension differential between the slickline located within the wellbore and the slickline located within the housing 223. For example, as can be seen in FIGS. 1 and 2, a first end 211 of the slickline can be attached to a downhole tool or equipment 100. The weight of the downhole tool or equipment 100, along with the force of gravity can pull on the slickline 210 and create a longitudinal tension on the slickline 210. This tension may be sufficient in some cases, to cause the slickline 210 to move from the receptacle 202 and through the housing 223. In these cases, the controlled deployment device 220 can also include a breaking motor 222. The breaking motor can cause an increase in latitudinal tension to be applied to the slickline 210 located within the housing 223 to stop movement of the slickline into the wellbore 11. The motor(s) can also be used to thread the slickline 210 into the receptacle 202.

The controlled deployment device 220 can further include a meter (not shown). The meter can be used to monitor and display how many feet of slickline has passed through the housing 223. This information can be useful in determining the location of the first end of the slickline 211 or the downhole tool or equipment 100 within the wellbore 11.

The receptacle 202 further includes an opening 205. The opening 205 can be perpendicular to the base 206. In this manner, the receptacle 202 is preferably oriented such that the receptacle 202 lays on its side during movement of the slickline 210 (i.e., the base 206 is perpendicular to a plane of the table 18 or earth or other object having a parallel plane to the earth's surface). This orientation allows for the longitudinal axis of the slickline to also be parallel to the earth's surface at the location of the opening. In this manner, there would be little to no longitudinal tension on the slickline at the opening or within the housing. An end of the housing 223 located closest to the opening 205 of the receptacle 202 or the primary guide 204 can be located within a desired distance. The desired distance can be selected such that the slickline 210 located within that distance does not substantially bend and very little, if any, tension is exerted on the slickline. In this manner, the slickline can be removed from or threaded into the receptacle and maintain a straight path from the opening or primary guide to the housing and vice versa.

The opening 205 can be located at the plane that truncates the apex (shown in FIG. 3) or the apex (shown in FIG. 4) of the receptacle 202. The slickline 210 can be introduced into and removed from the receptacle via the opening 205. According to certain method embodiments, a method of housing a slickline for use in a wellbore comprises: positioning a portion of the slickline into a controlled deployment device, wherein the controlled deployment device comprises a housing; and inserting the slickline into a receptacle using the controlled deployment device, wherein the receptacle is hollow and cone-shaped, and wherein after the step of inserting, the slickline is housed inside of the receptacle. These embodiments can be useful for housing and/or storing the slickline prior to use. The methods can further include storing the slickline inside of the receptacle after the step of inserting. The methods can also further include transporting the slickline and the receptacle to a worksite after the step of inserting. Accordingly, one can place the receptacle, which houses the slickline inside of the receptacle onto a vehicle and transport the receptacle and slickline to a worksite. Once at the worksite, the slickline can be deployed from the inside of the receptacle and into the wellbore (as discussed above).

Figure 6:
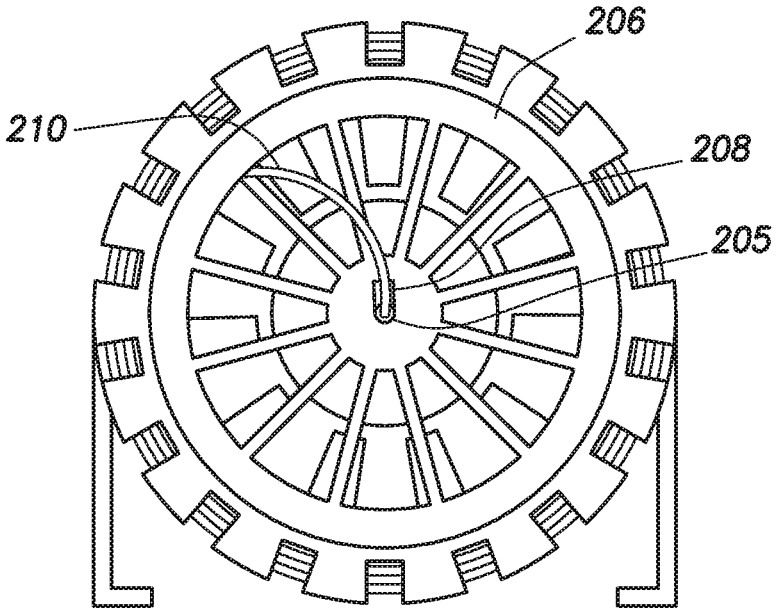
FIG. 6 is a front cross-sectional view of the receptacle showing the slickline located within the receptacle.
Figure 7:
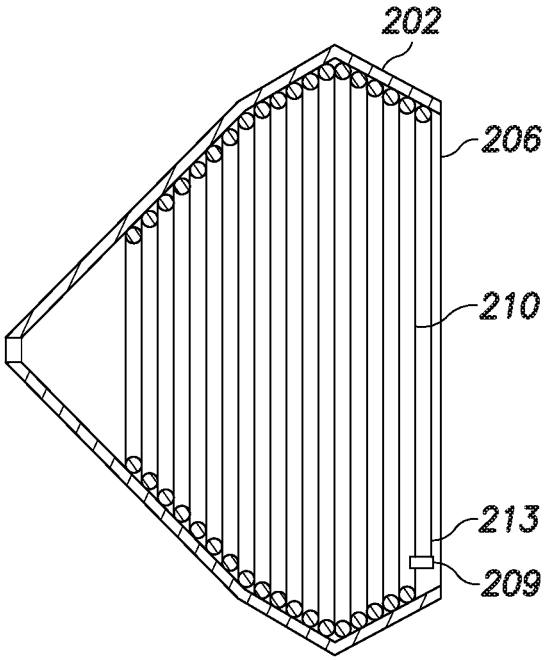
FIG. 7 is a side cross-sectional view of the receptacle showing layers of the slickline inside.

The slickline 210 is positioned inside of the receptacle 202 during the step of inserting or during the step of placing (i.e., prior to use in the wellbore or after use in the wellbore). As can be seen in FIG. 7, the slickline 210 can be wrapped inside of the receptacle 202 such that multiple layers of the slickline are created inside of the receptacle. The receptacle 202 can further include a primary guide 204. The primary guide 204 can be used to help lay the layers of slickline. Referring now to FIGS. 6 and 7, the slickline 210 can be introduced into the receptacle 202 via the opening 205 and possibly the driving motor 221 of the controlled deployment device 220. The primary guide 204 can also include an orientor 208 that is curved towards the perimeter of the base 206. The stiffness of the slickline 210 causes the slickline to move towards the inside of the wall or corner nearest the base of the receptacle. The slickline will then move along the inside of the wall of the receptacle and will generally conform to a substantially circular shape. The slickline will continue to move along this circular pattern inside of the receptacle, building additional layers of slickline with each full revolution. The primary guide 204 and orientor 208 can rotate, thus helping the slickline to maintain the circular pattern and lay uniform layers within the receptacle without the layers becoming tangled. According to certain embodiments, one complete layer is formed before another layer begins forming. A complete layer is one in which the slickline lies completely around the inside of the wall of the receptacle.

According to certain embodiments, once the slickline 210 is located within the receptacle 202, there is no longitudinal tension on the slickline. There can be some tension due to bending and/or twisting of the slickline. The amount of tension due to bending and/or twisting can be dependent on the thickness of the line, the stiffness of the line, and the inner diameter of the receptacle. According to certain embodiments, the amount of tension placed on the slickline 210 within the receptacle 202 is less than or equal to a desired amount. The desired amount can be the amount where significant damage does not occur to the strands of the slickline (including any fiber optic or communications cables) over a length of time. The length of time can be in the range of about 1 day to several years. The inner diameter of the receptacle 202 can be adjusted to provide the desired tension. The inner diameter can be directly related to the thickness and stiffness of the slickline. By way of example, the inner diameter of the receptacle 202 can be increased when the thickness of the slickline or the stiffness of the slickline increases. In this manner, the tension can be controlled such that significant damage does not occur to the slickline. However, the inner diameter should not be so large that the slickline does not have enough energy to be forced to the furthest back location along the inside of the wall of the receptacle. In other words, the slickline should have enough force to naturally move to the location as close as possible to the base and inside of the wall, move along the inside of the wall and move forward towards the opening of the receptacle with each revolution of the slickline. In this manner level winding can occur.

Figure 5:
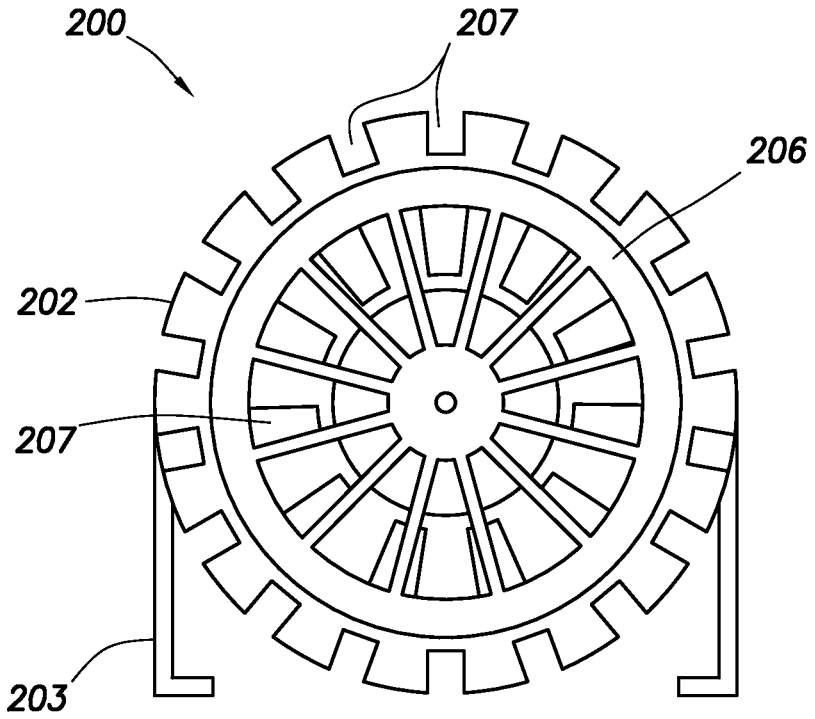
FIG. 5 is a back cross-sectional view of the receptacle according to certain embodiments.

As shown in FIGS. 3-5, the receptacle 202 can further include one or more windows 207. The windows can be perforations. The windows 207 can be located along the sides and/or on the base 206 of the receptacle 202. The windows can be a variety of shapes and sizes. The windows can be hollow or can include a covering, for example a transparent thermoplastic. A covering can be useful when it is desired to view the inside of the receptacle while still protecting the slickline from some environmental conditions, such as rain. The windows 207 can be used to view the laying of the slickline 210 inside the receptacle 202. The windows can also decrease the overall weight of the receptacle. Of course the receptacle can be made with solid sides and a base. Solid sides and a base can help protect the slickline from environmental conditions, such as rain or ultraviolet radiation from the sun.

As can be seen in FIG. 7, the receptacle 202 can also include an anchoring point 209. The anchoring point can be located on the base 206 or wall or side of the receptacle 202. Preferably, if the anchoring point is located on the wall, then the location is as close to the base as possible. This will allow for even layers to be formed without tangling. A second end 213 of the slickline can be secured to the anchoring point 209. This can help ensure that the slickline 210 is attached to the receptacle 202 and will not completely pull out of the receptacle. The second end 213 of the slickline can also be connected to a power supply or a transmitter or receiver, for example, for powering or communicating with downhole tools or equipment 100. It is to be understood that unlike a traditional drum used to house slicklines, the receptacle 202 is non-rotating. In other words, in order to deploy the slickline into the wellbore or back into the receptacle, the receptacle does not require and preferably excludes any rotation of the receptacle 202. This advantage allows the anchoring point 209 and the second end 213 of the slickline to remain stationary during movement into the wellbore or receptacle. This allows easier connections to power supplies and such to be made and maintained. This also allows these connections to be made or changed without having to stop deployment or movement of the slickline.

The methods include causing at least a portion of the slickline 210 to enter the wellbore 11. The step of causing can include activating one or more motors of the controlled deployment device 220. The storage and deployment system 200 can further include one or more secondary guides 201, such as a sheave or pulley. The secondary guides can be arranged in a variety of fashions (two different embodiments being illustrated in FIGS. 1 and 2). The secondary guide(s) can help place the slickline 210 in the desired location within the wellbore 11. The slickline 210 can be run through a stuffing box 212 located at or near the wellhead 16. The slickline 210 can also be run through a variety of other components commonly used in wellbore operations requiring the use of a slickline.

The methods can further include conducting one or more wellbore operations with the slickline. The wellbore operations can be completion, workover, and/or intervention operations.

The methods can further include placing the slickline 210 into the inside of the receptacle 202 after completing the wellbore operation. The step of placing can include activating the motor(s) of the controlled deployment device 220. The slickline can now be stored within the receptacle until the slickline is needed for another wellbore operation.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of deploying a slickline into a wellbore comprising:

positioning a portion of the slickline into a controlled deployment device, wherein the slickline is housed on the inside of a receptacle, wherein the receptacle is hollow and cone-shaped, wherein the receptacle is non-rotating, and wherein the controlled deployment device comprises a housing; and causing at least a portion of the slickline to enter the wellbore, wherein the slickline moves from the receptacle through the housing and into the wellbore during the step of causing; wherein the distance between the housing and the receptacle is such that the slickline maintains a substantially straight path between the housing and the receptacle.

2. The method according to claim 1, wherein the wellbore penetrates a subterranean formation.

3. The method according to claim 1, wherein the slickline comprises a composite material, and wherein the composite material includes a plurality of carbon fiber strands.

4. The method according to claim 3, wherein the slickline further comprises one or more fiber optic cables and/or one or more communication lines.

5. The method according to claim 1, wherein the slickline is made from an anisotropic material.

6. The method according to claim 1, wherein the receptacle is made from a material selected from the group consisting of metals, metal alloys, wood, plastics, composites, and combinations thereof.

7. The method according to claim 1, wherein the receptacle comprises a base, and wherein the base has a geometric shape selected from circular, elliptical, or polygonal.

8. The method according to claim 1, wherein the housing comprises a passageway for the movement or passage of the slickline.

9. The method according to claim 8, wherein the passageway creates a desired amount of latitudinal tension along the length of the portion of the slickline located within the housing.

10. The method according to claim 1, wherein the controlled deployment device further comprises one or more motors.

11. The method according to claim 10, wherein the one or more motors moves the slickline from the receptacle through the housing and into the wellbore.

12. The method according to claim 1, wherein the receptacle further comprises an opening, and wherein the slickline is moved from the receptacle via the opening.

13. The method according to claim 1, further comprising placing the slickline into the inside of the receptacle after the step of causing.

14. The method according to claim 13, wherein the slickline is placed into the inside of receptacle such that multiple layers of the slickline are created inside of the receptacle.

15. The method according to claim 14, wherein the receptacle further comprises a primary guide, wherein the primary guide aids in creating the multiple layers of slickline.

16. The method according to claim 1, further comprising conducting one or more wellbore operations with the slickline after the step of causing.

17. The method according to claim 16, wherein the one or more wellbore operations are completion, workover, and/or intervention operations.

18. A method of housing a slickline for use in a wellbore comprising:

positioning a portion of the slickline into a controlled deployment device, wherein the controlled deployment device comprises a housing; and inserting the slickline into a receptacle using the controlled deployment device, wherein the receptacle is hollow and cone-shaped, wherein the receptacle is non-rotating, and wherein after the step of inserting, the slickline is housed inside of the receptacle; wherein the distance between the housing and the receptacle is such that the slickline maintains a substantially straight path between the housing and the receptacle.

19. The method according to claim 18, further comprising storing the slickline inside of the receptacle after the step of inserting.

20. The method according to claim 18, further comprising transporting the slickline and the receptacle to a worksite after the step of inserting.

21. The method according to claim 20, further comprising positioning a portion of the slickline into a controlled deployment device; and causing at least a portion of the slickline to enter a wellbore, wherein the slickline moves from the receptacle through a housing of the controlled deployment device and into the wellbore during the step of causing, wherein the step of causing is performed after the step of transporting.

22. A slickline system for use in a wellbore comprising:

(A) a receptacle, wherein a slickline is housed on the inside of the receptacle, and wherein the receptacle is hollow and cone-shaped, wherein the receptacle is non-rotating, wherein the slickline comprises a composite material comprising a plurality of carbon fiber strands; and (B) a controlled deployment device, wherein the controlled deployment device comprises a housing, and wherein the controlled deployment device deploys at least a portion of the slickline into or from the receptacle, wherein the distance between the housing and the receptacle is such that the slickline maintains a substantially straight path between the housing and the receptacle.

23. The system according to claim 22, wherein the slickline further comprises one or more fiber optic cables and/or one or more communication lines.

* * * * *